US006216609B1

(12) United States Patent
Frankenberg

(10) Patent No.: US 6,216,609 B1
(45) Date of Patent: Apr. 17, 2001

(54) STRUCTURAL CHANNEL PALLET

(75) Inventor: Jason R. Frankenberg, Waukesha, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 09/391,261

(22) Filed: Sep. 7, 1999

Related U.S. Application Data

(60) Provisional application No. 60/101,450, filed on Sep. 15, 1998.

(51) Int. Cl.[7] ..... B65D 19/38
(52) U.S. Cl. ..... 108/57.25
(58) Field of Search ..... 108/57.25, 57.28, 108/57.34, 55.3, 901, 902

(56) References Cited

U.S. PATENT DOCUMENTS

| | | | | |
|---|---|---|---|---|
| 3,187,689 | * | 6/1965 | Hess | 108/57.25 |
| 3,424,110 | * | 1/1969 | Toot | 108/901 X |
| 3,526,195 | * | 9/1970 | Maryonovich | 108/901 X |
| 3,680,495 | | 8/1972 | Pike . | |
| 3,707,127 | * | 12/1972 | Palfey | 108/901 X |
| 3,736,885 | * | 6/1973 | Freund | 108/57.28 |
| 4,051,787 | * | 10/1977 | Nishitani et al. | 108/55.3 |
| 4,428,306 | | 1/1984 | Dresen et al. . | |
| 4,498,860 | | 2/1985 | Gahan . | |
| 4,740,150 | | 4/1988 | Sayer . | |
| 4,824,732 | | 4/1989 | Hendry et al. . | |
| 4,923,666 | | 5/1990 | Yamazaki et al. . | |
| 4,923,667 | | 5/1990 | Sayer . | |
| 5,483,899 | * | 1/1996 | Christie | 108/901 X |
| 5,549,056 | * | 8/1996 | Jordan et al. | 108/57.25 |
| 5,596,933 | * | 1/1997 | Knight et al. | 108/901 X |
| 5,606,921 | * | 3/1997 | Elder et al. | 108/53.1 X |
| 5,666,886 | * | 9/1997 | Alexander et al. | 108/901 X |
| 5,676,064 | * | 10/1997 | Shuert | 108/57.25 |
| 5,736,221 | | 4/1998 | Hardigg et al. . | |
| 5,770,237 | | 6/1998 | Sayer et al. . | |
| 5,809,905 | * | 9/1998 | John et al. | 108/901 X |
| 5,845,588 | * | 12/1998 | Gronnevik | 108/57.25 X |
| 5,967,057 | * | 10/1999 | Nakayama et al. | 108/57.25 |
| 6,018,927 | * | 2/2000 | Major | 108/57.25 X |

FOREIGN PATENT DOCUMENTS

| | | | | |
|---|---|---|---|---|
| 202203 | * | 11/1986 | (EP) | 108/57.28 |

* cited by examiner

*Primary Examiner*—Jose V. Chen
(74) *Attorney, Agent, or Firm*—Quarles & Brady LLP

(57) ABSTRACT

A structural channel pallet having improved structural integrity without adding material to increase the pallet weight. The pallet has a deck having a top and a bottom, and a number of feet are formed extending downwardly from the deck. Ribs define an open grid pattern in the deck, and hollow channels are formed in the deck, which increases the strength of the pallet, without disproportionately increasing the volume or weight of material used. The hollow channels are formed at strategic locations on the top and the bottom of the deck.

20 Claims, 9 Drawing Sheets

STRUCTURAL CHANNEL PALLET

CROSS-REFERENCE TO RELATED APPLICATIONS

This application claims the benefit of U.S. Provisional Patent Application No. 60/101,450 filed Sep. 15, 1998.

STATEMENT REGARDING FEDERALLY SPONSORED RESEARCH OR DEVELOPMENT

Not Applicable.

FIELD OF THE INVENTION

The field of the invention is pallets, and more particularly, injection molded plastic pallets having structural hollow channels.

BACKGROUND OF THE INVENTION

Plastic pallets are in common use in many industries. They are used as load platforms for easily transporting loads using material handling equipment, such as fork lift trucks and the like. A typical pallet has a deck with an upper surface for supporting a load and a lower surface which is engaged by the material handling equipment when in transit.

The load on a typical pallet causes the pallet deck to deflect concave upward in the areas between the feet and to compress the feet of the pallet, while lifting or transporting the pallet by engaging the material handling equipment causes the pallet deck to deflect concave downward. Constant movement of the pallet subjects a pallet deck to a continuous cycle of upward and downward deflections, weakening the pallet structure and eventually causing the pallet to fail.

One method which prolongs the life of a plastic pallet is to add material to the structural components of the pallet increasing the pallet stiffness and capability to withstand many deflection cycles. This method, however, increases the weight and cost of the pallet.

Plastic pallets have in general been made by either rotational molding, single of twin sheet vacuum thermoforming, or injection molding. Rotational molding and vacuum thermoforming can be used to create voids within the pallets, but also results in thin walled sections of relatively low strength. Injection molding is capable of forming thicker walled sections and solid reinforcing ribs resulting in a pallet of solid material with less strength than what the same volume of material is capable of. Thus, a need exists for a method of increasing the strength of material handling pallets, without increasing the weight or cost.

SUMMARY OF THE INVENTION

The present invention provides an injection molded structural channel pallet having improved structural integrity without adding material to increase the pallet weight. The pallet has a deck having a top and a bottom, and a number of feet are formed extending downwardly from the deck. Ribs define an open grid pattern in the deck, and hollow channels are formed in the deck, which increases the strength of the pallet, without disproportionately increasing the volume of weight of material used. The hollow channels are formed at strategic locations on the top and the bottom of the deck.

A general objective of the present invention is to provide an injection molded plastic pallet having increased strength, while reducing its weight and volume of material used in comparison to a solid pallet of the same capacity or exterior dimensions. This objective is accomplished by forming hollow channels at strategic locations in the pallet deck. In one embodiment the hollow channels strategically define substantially identical patterns in pallet quadrants defined by a pallet longitudinal and lateral axis. Each channel pattern has primary channels. One primary channel extends along a diagonal across the quadrant. Secondary channels may branch off of at least one of the primary channels.

Another objective of the present invention is to reduce pallet deflection when the pallet is supporting a load or being lifted by material handling equipment. This objective is accomplished by providing hollow channels in a pattern which cross over between the pallet deck top and bottom.

Yet another objective of the present invention is to provide a pallet with strengthened feet to support the pallet deck, and increase the pallet load capacity. This objective is accomplished by forming hollow channels around the feet top and down along the feet sides. In one embodiment, the primary channels in the pattern encircle the tops of the pallet feet, and are formed in the corners of convolutions in the feet sides.

The foregoing and other objects and advantages of the invention will appear from the following description. In the description, reference is made to the accompanying drawings which form a part hereof, and in which there is shown by way of illustration a preferred embodiment of the invention.

DETAILED DESCRIPTION OF THE PREFERRED EMBODIMENTS

Figure 1:
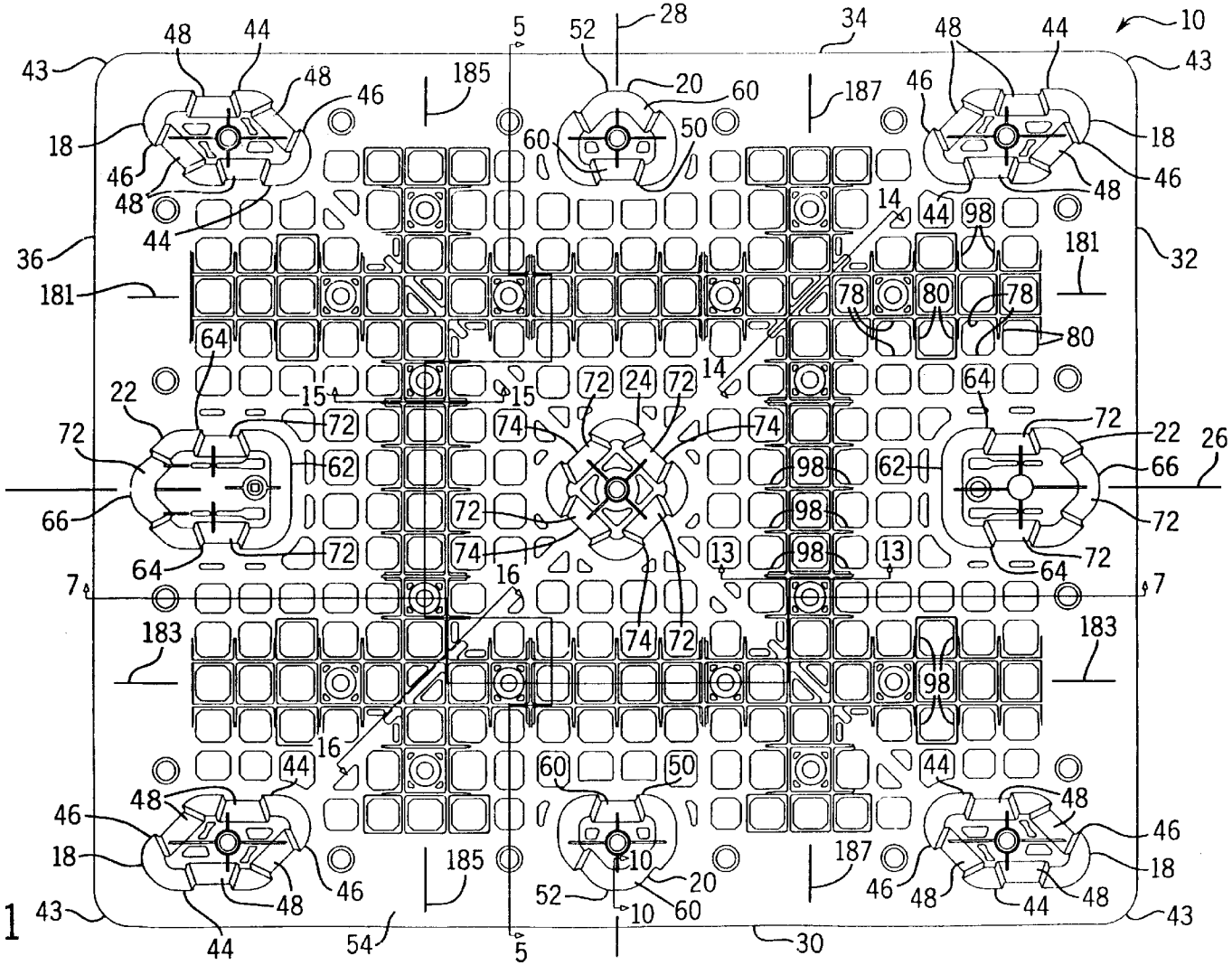
FIG. 1 is a top plan view of a pallet incorporating the present invention.

Referring to FIGS. 1–9, a structural channel pallet 10 has a deck 12 with a top 14 and a bottom 16. The deck 12 is supported by a plurality of feet 18, 20, 22, 24 which are integrally formed as part of the deck 12. When supported by the feet, the deck top 14 supports a load (not shown) which causes the deck 12 to deflect convex downward, increasing the tensile stress in the deck bottom 16. Conversely, the pallet 10 is lifted using material handling equipment, such as a fork lift, engaging the deck bottom which deflects the deck 12 to take on a convex upward shape, causing tensile stress in the deck top 14. Structural channels 17, 19, more clearly shown in FIGS. 12A and 12B, formed in the deck top 14 and bottom 16, and feet 18, 20, 22, 24 increase the structural integrity of the pallet 10 without increasing the pallet weight.

Referring to FIG. 1, the pallet 10 is generally rectangular having a longitudinal axis 26, a lateral axis 28, and two opposing sides 30, 34 joined together by two opposing ends 32, 36. The pallet 10 is formed from by injection molding thermoplastic material, such as polyethylene, using a molding method which forms channels in the thermoplastic materials, such as the injection molding techniques described in U.S. Pat. Nos. 4,498,860; 4,740,150; 4,824,732; 4,923,666; 4,923,667; and 5,770,237, which are hereby incorporated by reference. Other methods known in the art to form hollow channels may be used, such as inserting pins in the molten material or the like, without departing from the scope of the present invention.

The pallet 10 has a total of nine feet supporting the deck 12; four corner feet 18, one at each pallet corner 43; two side feet 20, one on each pallet side 30, 34 disposed between adjacent corner feet 18; two end feet 22, one on each pallet end 32, 36 disposed between adjacent corner feet 18; and one center foot 24 generally located at the intersection of the longitudinal and lateral axes 26, 28. Looking particularly at FIGS. 4–7, each foot 18, 20, 22, 24 is cup shaped having an open top 38 formed at the deck top 14, and extends through the deck bottom 16 for engagement of a supporting surface by the foot bottom 40. The open feet tops 38 receive the feet bottoms of a like configured stacked pallet. Fins 42 formed in the feet bottom 40 support the stacked pallet and maintain a vertical separation between stacked pallets when the feet of an upper pallet are nested within the feet of a lower pallet.

Referring to FIG. 1, the pallet corner feet 18 support the pallet corners 43 and are generally trapezoidal shaped having four sides 44, 46 and rounded corners 51. First and second sides 44 are spaced apart and substantially parallel to the pallet longitudinal axis 26. The third and fourth sides 46 are spaced apart joining the first and second sides 44 at an angle for guiding lift equipment, such as lift truck forks, into a space 49 (shown in FIGS. 4–7) between a corner foot 18 and an adjacent side foot 20, 22. Convolutions 48 in each corner foot side 44, 46 enhance the load carrying capacity of each foot 18.

Two side feet 20 formed at each side 30, 34 are generally D-shaped having an inner side 50 substantially parallel to the longitudinal axis 26, and a curved side 52 bulging outward away from the center foot 24. The curved side 52 of the foot 20 guides lift equipment into the space 49 between the side foot 20 and an adjacent corner foot 18. Each side 50, 52 of each side foot 20 has a convolution 60 strengthening the bearing capacity of the foot 20.

Two end feet 22 are generally bullet shaped having an inner side 62 substantially parallel to the lateral axis 28, a pair of spaced sides 64 substantially parallel to the longitudinal axis 26 and joined by the inner side 62, and a nose 66 pointing outward away from the center foot 24. The nose 66 guides lift equipment into the space 49 between the end foot 22 and an adjacent corner foot 18. Each of the spaced sides 64 and the nose 66 have a convolution 72 strengthening the bearing capacity of the foot 22.

The center foot 24 is generally square having four sides 74, and centrally located in the pallet 10 at the intersection of the longitudinal and lateral axes 26, 28. Each side 74 is approximately at a 45 degree angle to each axis 26, 28 and has a convolution 72 strengthening the bearing capacity of the foot 24.

Figure 3:
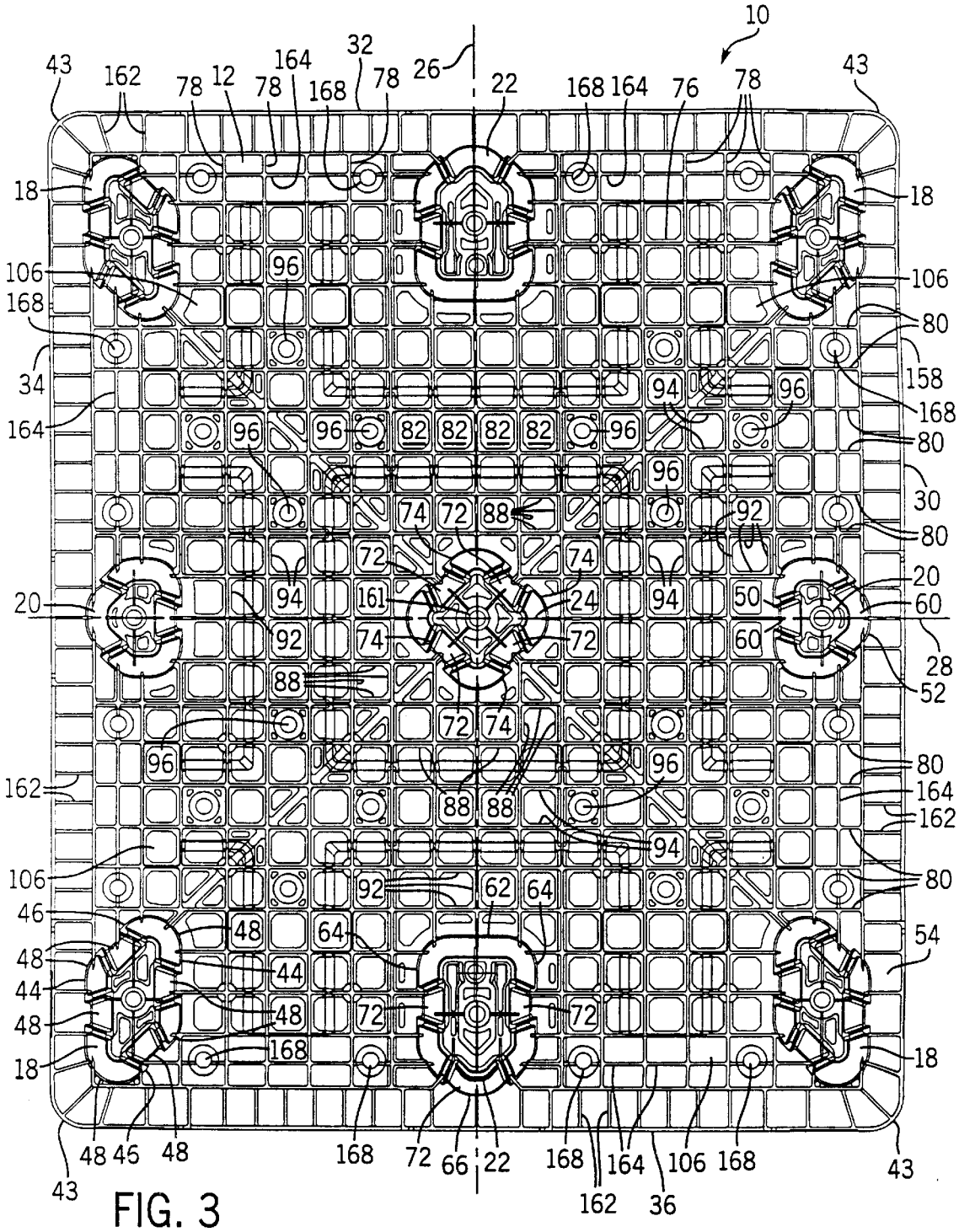
FIG. 3 is a transparent plan view of a pallet incorporating the present invention.
Figure 4:
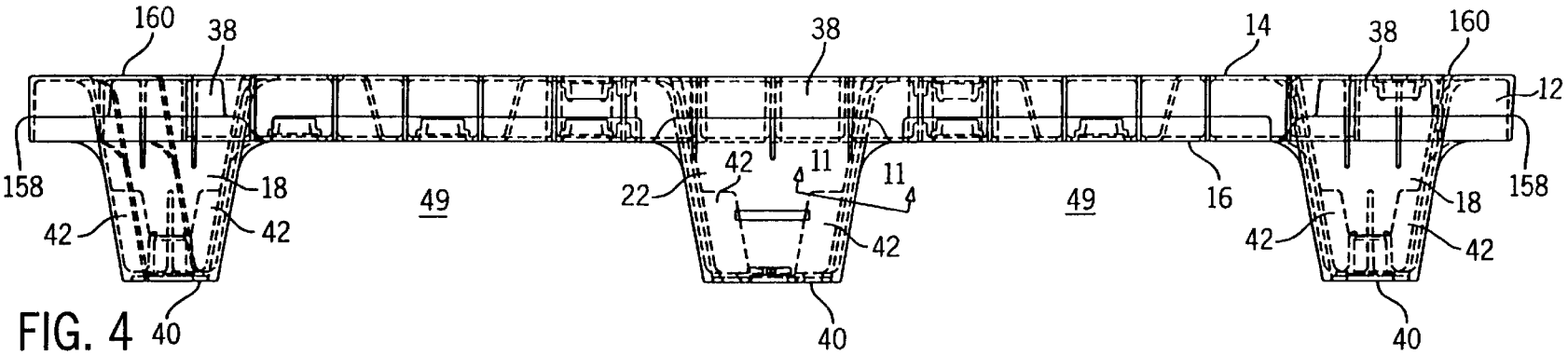
FIG. 4 is a transparent end view of FIG. 1.

Looking particularly at FIG. 3, the pallet deck 12 is a grid 76 formed of a plurality of spaced ribs 78, 80 and an edge portion 54 integrally formed around the circumference of the grid 76. Preferably, the grid 76 is formed by a set of nineteen longitudinal ribs 78 which are substantially parallel to the longitudinal axis 26 and a set of twenty-three lateral ribs 80 perpendicular to the longitudinal ribs 78 and substantially parallel to the lateral axis 28. The intersecting ribs 78, 80 define grid squares 82.

Figure 5:
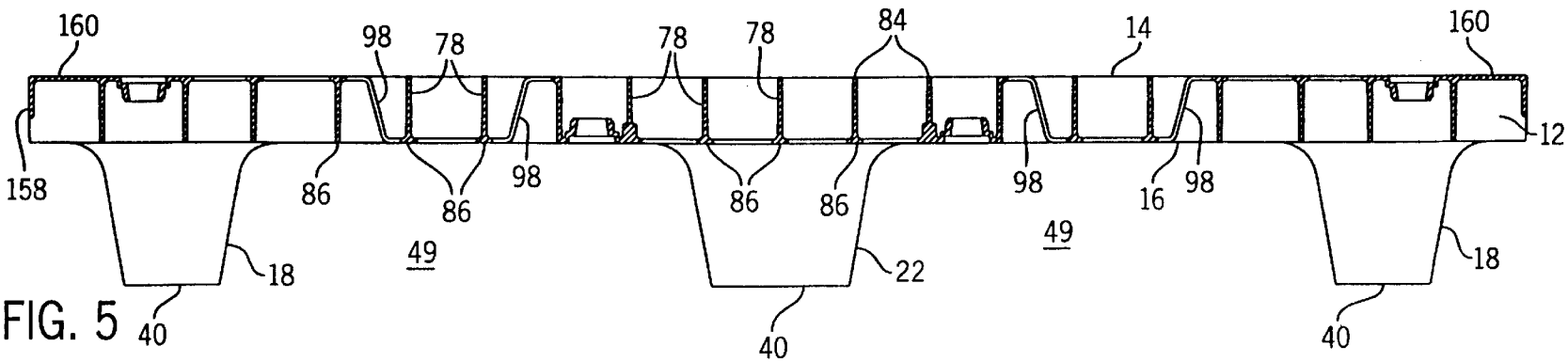
FIG. 5 is a section view along line 5—5 of FIG. 1.
Figure 6:
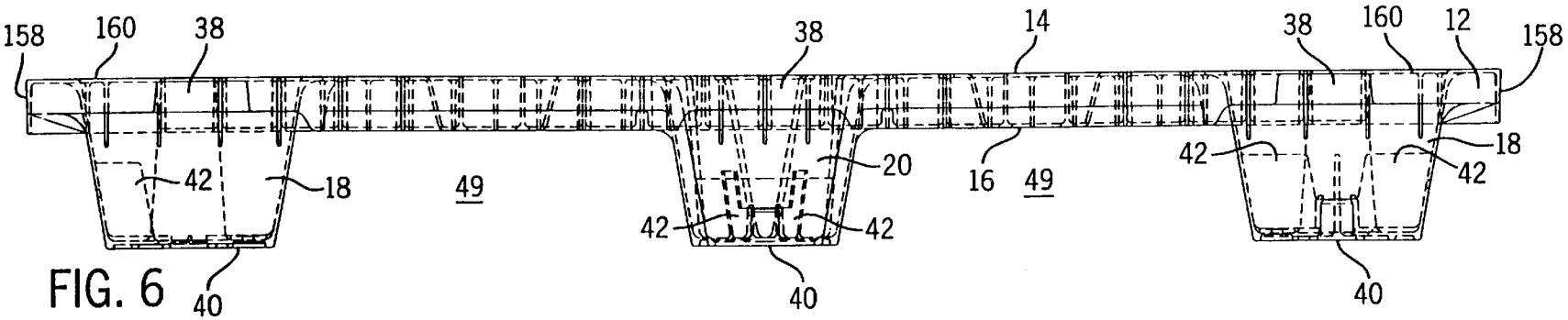
FIG. 6 is a transparent side view of FIG. 1.
Figure 7:
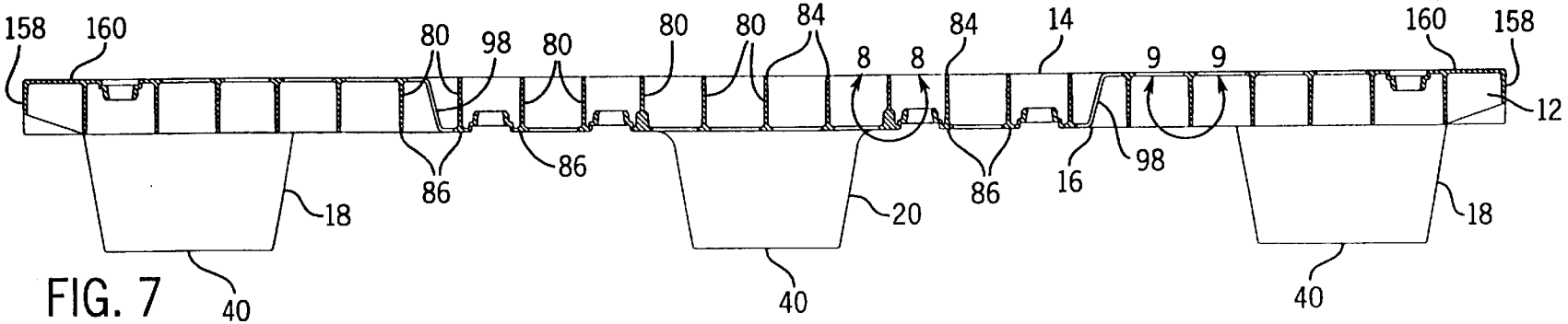
FIG. 7 is a section view along line 7—7 of FIG. 1.

Looking particularly at FIGS. 5 and 7, the ribs 78, 80 are substantially narrower in width than in depth having upper edges 84 and lower edges 86. The upper edges 84 are substantially coplanar and define the deck top 12 and the rib lower edges 86 are substantially coplanar defining the deck bottom 16.

Figure 2:
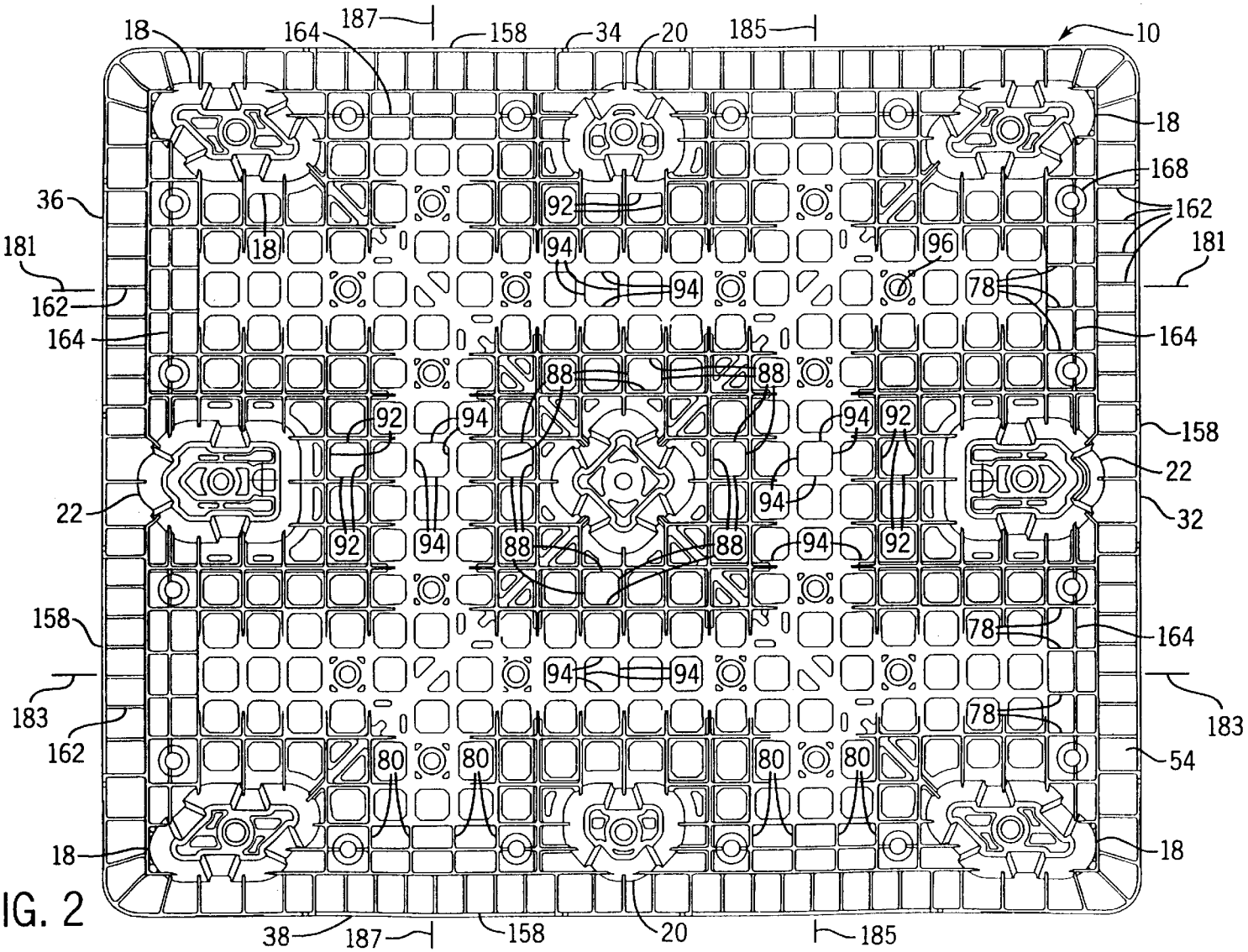
FIG. 2 is a bottom plan view of the pallet of FIG. 1.

Referring to FIG. 2, structural flanges 88 formed on the rib upper edges 84 encircling the center foot 24 define a square shape. The structural flanges 88 help resist tensile elongation of the ribs 78, 80 around the center foot 24, for example when picking up the pallet with a fork lift. Additional structural flanges 92 formed on the rib upper edges 84 encircling the feet 18, 20, 22, and 24 strengthen the deck 12 around the feet 18, 20, 22 and 24. Structural flanges 94 along rib lower edges 86 of ribs adjacent to bottom holes 96 strengthen the ribs 78, 80.

As shown in FIGS. 1–3, crossover flanges 98 formed along rib faces 100 crossover from upper structural flanges 88 to lower structural flanges 94 and vice versa. The crossover flanges 98 provide additional structural integrity to the ribs 78, 80, and also make the upper and lower structural flanges 88, 94 continuous with one another, which assists in supporting tensile and also compressive loads on the flanges. Referring to FIG. 12B, the crossover flanges 98 occur at positions between, and run in the direction that extends between, two adjacent feet, so as to position the lower flanges 94 in the squares 82 which are approximately midway between the two adjacent feet. This creates a pattern in the pallet 10, with the laterally running lower flanges 94 and their corresponding crossovers 98 centrally positioned along axes 181 and 183 (FIG. 1) and the longitudinally running lower flanges 94 and their corresponding crossovers 98 centrally positioned along axes 185 and 187.

All crossovers, including the channel crossovers described below, are positioned along one (or two in the case of diagonal channel 128) of the axes 181, 183, 185 and 187. The crossover flanges 98 and corresponding lower flanges 94 which they run into are positioned in the area between the feet, and one to two squares to each side of the area which is directly between the feet. As such, the flanges 94 are on nearly every rib 78 or 80 along the respective axes 181, 183, 185 and 187. However, where two of the axes 181, 183, 185 and 187 cross, in the square centered on the intersection of the two axes which has its corners defined by the outer corners of the squares 82 in which the channel crossover 154 and 155 occur (discussed below with reference to FIG. 12B), the only crossovers 98 are adjacent to the other two corners of the square, i.e., adjacent to the gates 110 and 114. Within this 3×3 square, which contains the nine squares 82 (3×3) which together are centered on each intersection of two crossover axes (with corners at gates 108, 110, 112 and 114), there is a concentration of lower flanges 94 for improved load carrying ability when the pallet is supported by the feet.

As shown in FIG. 12B, the crossover flanges 98 and corresponding lower flanges 94 associated with the pairs of adjacent feet are on the rib 78 or 80 outside of the aforementioned square, along the respective crossover axes 181, 183, 185 and 187. In addition, the holes 96 for the lower anti-skid grommets (not shown) for supporting the pallet 10 on fork lift forks are formed just outside of the 3×3 square.

Figure 8:
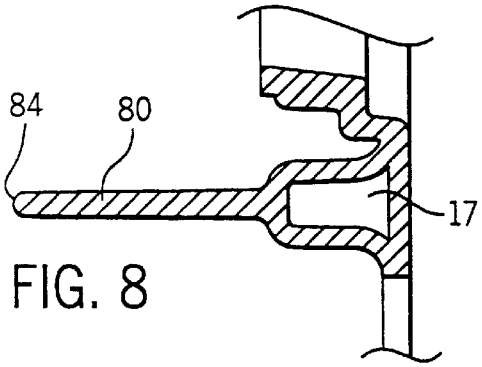
FIG. 8 is detail view B—B of FIG. 7.
Figure 9:
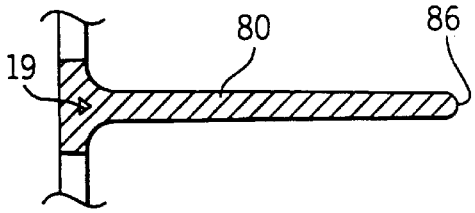
FIG. 9 is detail view C—C of FIG. 7.
Figure 12A:
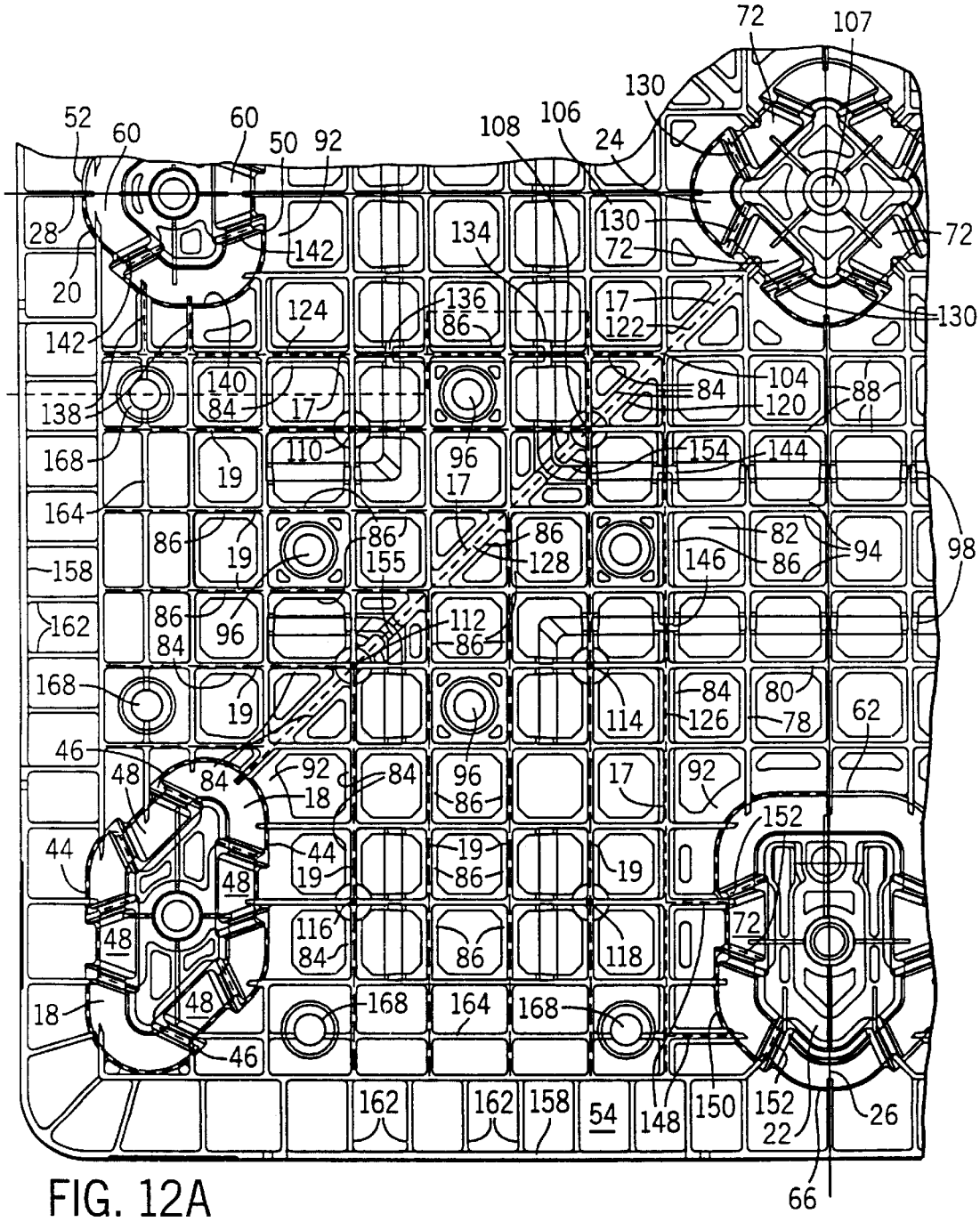
FIG. 12A is an enlarged fragmentary view of a single quadrant of the pallet, illustrated as if the pallet was transparent.
Figure 12B:
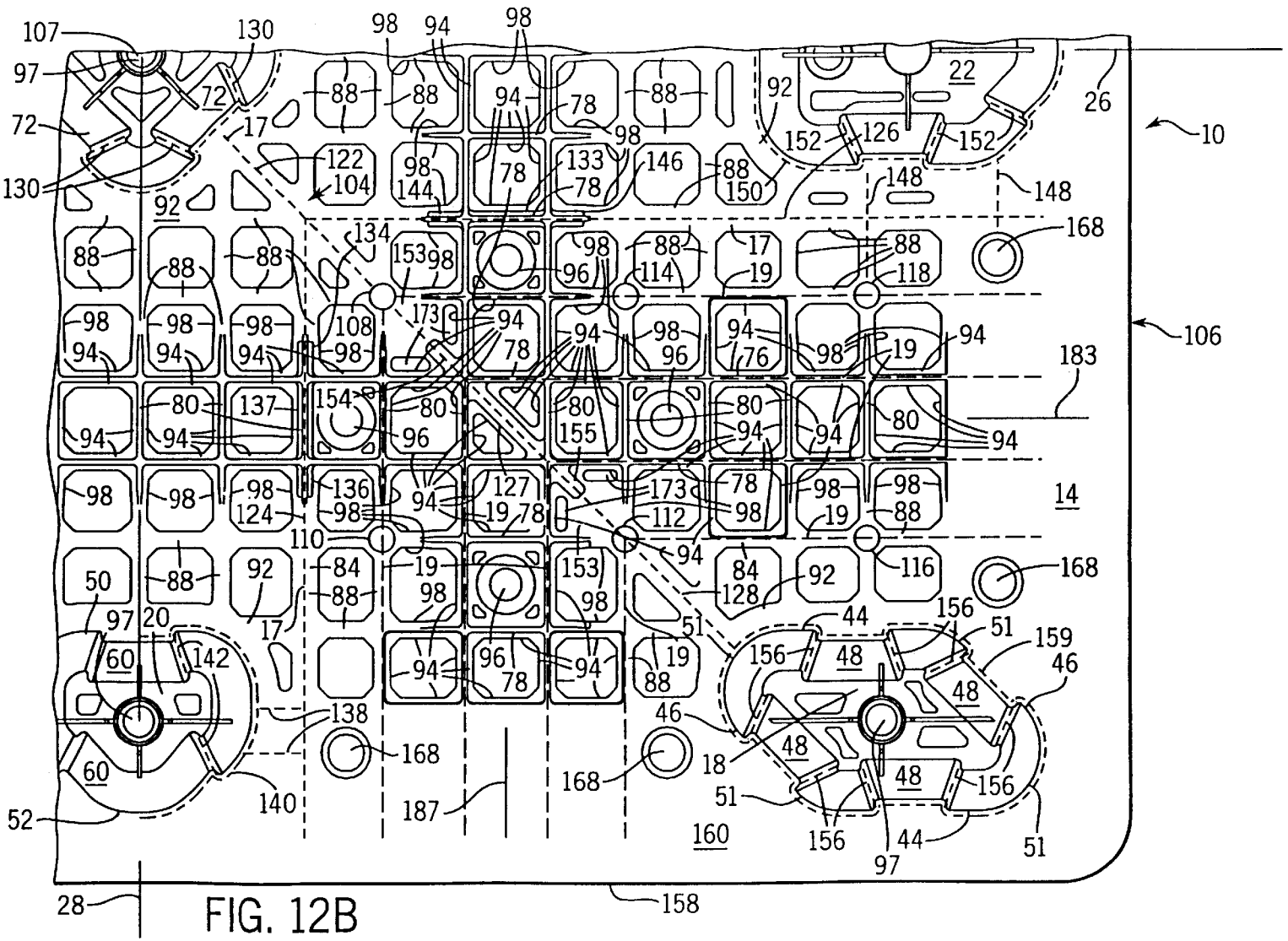
FIG. 12B is a view like FIG. 12A, but is a top view showing the quadrant opaque and not showing hidden lines.

Looking particularly at FIGS. 7–9, hollow channels 17, 19 which are part of a pattern 104, shown in FIG. 12 by respective short and long dashed lines, in each of four deck quadrants 106. The hollow channels 17, 19 increase the structural integrity of the pallet 10 without increasing the pallet weight. The channels 17, 19 define the pattern 104 on the deck top 14 and bottom 16. Each of the corner quadrants 106 is defined by the longitudinal axis 26 and lateral axis 28 intersecting at the deck center 107. The quadrants 106 are substantially identical to one another, being either the same as or mirror images of one another (diagonally opposite quadrants are the same, adjacent quadrants are mirror images of one another). Thus, the pattern 104 of channels 17, 19 in each quadrant 106 is identical in each of the four quadrants 106 of the deck grid 76. Referring to FIGS. 12A and 12B, each quadrant 106 preferably has six gates 108, 110, 112, 114, 116, and 118 for injecting the thermoplastic material into the mold. The gates 108, 110, 112, 114, 116, and 118 are spaced along the deck top 14 in a rectangular pattern ensuring an even distribution of thermoplastic material in each quadrant 106. In the preferred embodiment, one gate 108, nearest the center foot 24 and disposed along a diagonal 120 extending from the center foot 24 to the corner foot 18 in the quadrant 106, also injects gas in to the thermoplastic material forming the structural channels 17, 19, such as described in U.S. Pat. Nos. 4,498,860, 4,740,150, 4,824,732, 4,923,666, 4,923,667, and 5,770,237, referred to above. The gas injecting gate 108 defines the start of the channel pattern 104 in each quadrant 106.

Each channel pattern 104 has four primary channel legs 122, 124, 126, 128, illustrated with short dashed lines. From the area of the gate 108, each primary channel leg 122, 124, 126 and 128 extends toward a respective foot 24, 20, 22, or 18 at each corner of the quadrant 106. The cross-sectional shape of a primary channel 17 is shown in FIG. 8. Secondary channels 19, illustrated with longer dashed lines, run along the upper or lower edges 84, 86 of certain ribs 78, 80 which branch off of the primary channel leg 128. The cross-sectional shape of a secondary channel 19 is shown in FIG. 9, and has a significantly smaller open area than a primary channel 17. Accordingly, the primary channels 17 strengthen the pallet 10 more than the secondary channels 19.

Referring to the pattern 104 of primary and secondary channels 17, 19 indicated by respective short and long dashed lines in a single quadrant 106, as shown in FIGS. 12A and 12B, a first primary channel leg 122 extends along the diagonal 120 from the gas injecting gate 108 at the deck top 14 toward the center foot 24. The channel leg 122 extends around one-quarter of the center foot top 38 and down both corners 130 of a convolution 72 disposed within the quadrant 106. The legs 122 of the three other quadrants 106 also extend around their respective one-quarters of the top of the center leg 24 (and into the corners of the respective convolutions) so all the legs 22 communicate with one another at the top of the center leg 24. As in the ribs 78, 80, the hollow channels in the convolution corners 130 increase the structural integrity of the convolutions 72 without increasing the pallet weight.

Figure 10:
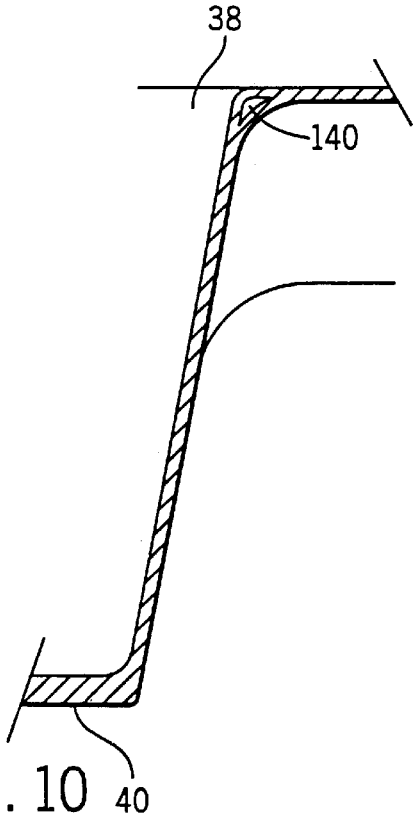
FIG. 10 is a section view along line 10—10 of FIG. 12B.
Figure 11:
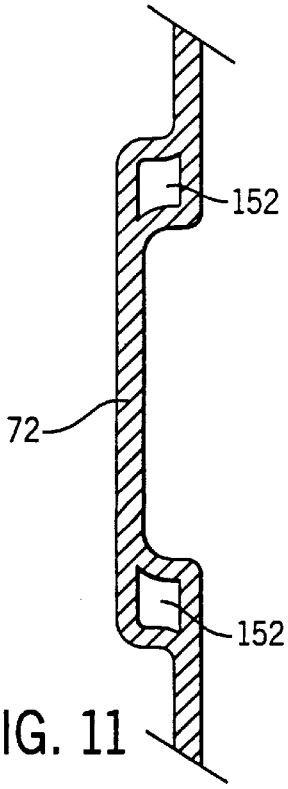
FIG. 11 is a section view along line 11—11 of FIG. 4.
Figure 13:
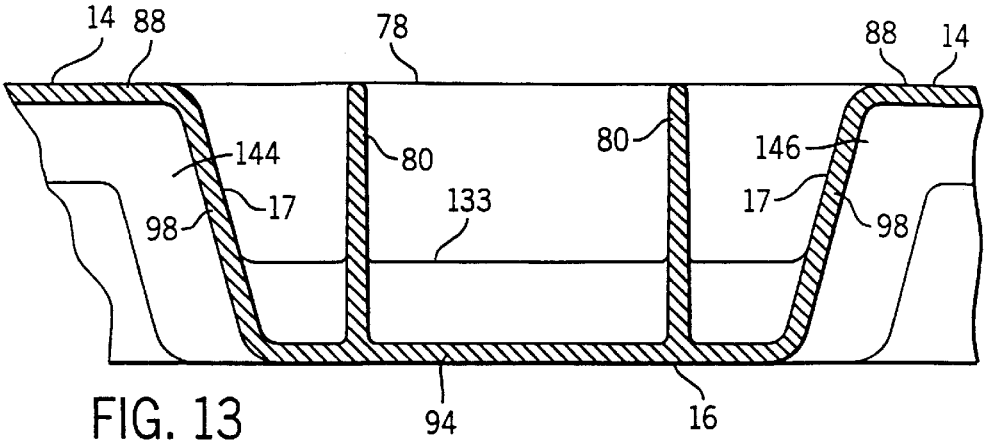
FIG. 13 is a section view along line 13—13 of FIG. 1.

A second primary channel leg 124 extends from the gas injecting gate 108 along the first primary channel leg 122 at least one grid square 82 toward the deck center foot 24. The second primary channel leg 124 then generally proceeds past one square 82 along the upper edge 84 of a lateral rib 80 to a first crossover subchannel 134 of the channel 124 which extends from the rib upper edge 84 to the rib lower edge 86 (FIG. 12B) to a lower subchannel 137. The cross sections of the channel 124 in this area is the same as for channel 126 as shown in FIGS. 13 an 14. Sub channel 137 extends along the lateral rib lower edge 86 past one full square 82 to a second crossover subchannel 136 of the channel 124 which extends from the rib lower edge 86 to the rib upper edge 84. The leg 124 then proceeds toward the deck side 34. Two channel extensions 138 along longitudinal ribs 78 extend from the second leg 124 to a channel 140, shown in FIG. 10, encircling approximately half of the adjacent side foot top 38 and down the two side foot convolution corners 142, shown in FIG. 11, which are disposed within the quadrant 106. The hollow channel extends all the way around the top of the foot 20, and other half of the channel being in the adjacent quadrant 106.

Figure 15:
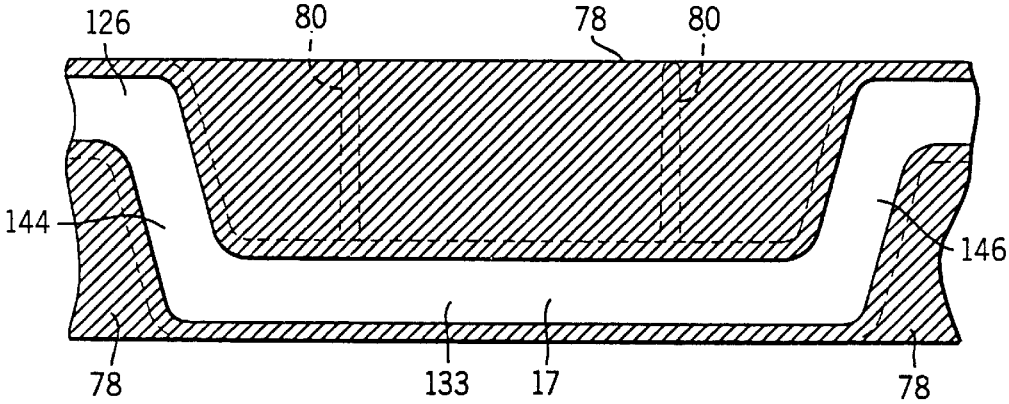
FIG. 15 is a section view along line 15—15 of FIG. 1.

As shown in FIGS. 13 and 15, the first and second crossover channels 134, 136 define a primary channel path from the deck top 14 to the deck bottom 16 and back to the top 14. By routing the hollow channel 124 on both the top 14 and bottom 16 of the pallet deck 12, pallet deflection is minimized when the pallet 10 is supporting a load or being lifted by material handling equipment.

A third primary channel leg 126 extends from the gas injecting gate 108 along the first primary channel leg 122 at least one grid square 82 toward the deck center foot 24. The third primary channel leg 126 then generally proceeds past one grid square 82 along the upper edge 84 of a longitudinal rib 78 to a first crossover subchannel 144 (FIGS. 12B, 13 and 15) of the channel 126 which extends from the rib upper edge 84 to the lower edge 86 and into subchannel 133 of channel 126. Subchannel 133 then extends along the lower edge 86 of the longitudinal rib 78 past one full square 82 to a second crossover subchannel 146 of the channel 126 which extends from the rib lower edge 86 to the rib upper edge 84. The channel leg 126 can generally proceeds toward the deck end 36. Two channel extensions 148 extend along upper edges 84 of lateral ribs 80 from the third leg 126 to a channel 150 encircling half of the adjacent end foot top 38 and down the three foot convolution corners 152 within the quadrant 106.

A fourth primary leg channel 128 extends from the injecting gate 108 along the diagonal 120 toward the deck corner foot 18 within the quadrant 106 into a crossover subchannel 154 of the channel 128 which extends from the deck top 14 to the deck bottom 16 along the diagonal 120 and into subchannel 127. Subchannel 127 extends along the diagonal 120 on the deck bottom 16 diagonally across the square 82 which is at the intersection of the two crossover axes (183 and 187 in FIG. 12B) which run through the quadrant to a second crossover subchannel 155 of the channel 128 which extends from the deck bottom 14 to the deck top 16.

Referring to FIG. 12B, in each square 82 in which primary channel 128 crosses over from top to bottom (i.e., in the squares 82 that contain crossovers 154 and 155), a protective web 153 (FIG. 12B) of plastic material extends from top to bottom diagonally across the square. The channels 154 and 155 extend through each web 153 relatively low in the square, so the web 153 covers the channel 154 or 155 at the upper reaches of the channel 154 or 155. Each web 153 defines holes 173 adjacent to their lower sides next to lower flanges 94, which permit drainage out of the square.

Figure 14:
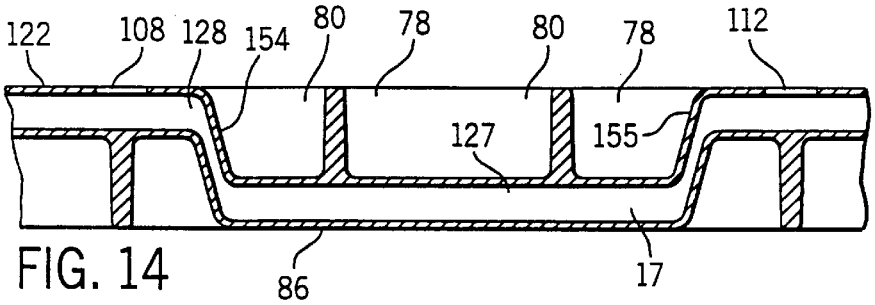
FIG. 14 is a section view along line 14—14 of FIG. 1.
Figure 16:
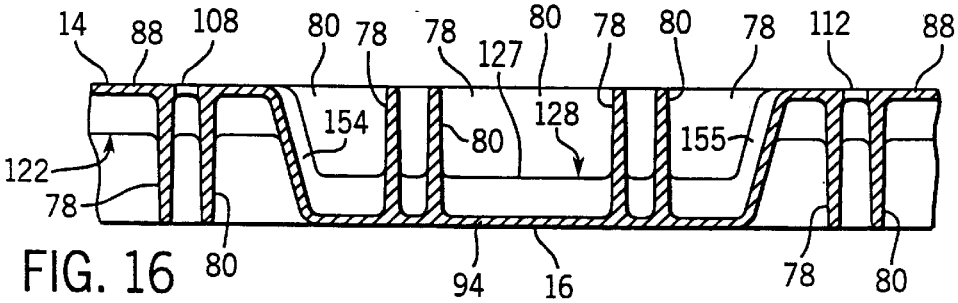
FIG. 16 is a section view along line 16—16 of FIG. 1.

As shown in FIGS. 14 and 16, the first and second crossover channels 154, 155 define a primary channel path from the deck top 14 to the deck bottom 16 and back to the top 14 along the diagonal 120. As in the other crossover channels, by routing the hollow channel 128 on both the top 14 and bottom 16 of the pallet deck 12, pallet deflection is minimized when the pallet 10 is supporting a load or being lifted by material handling equipment.

Secondary channels 19 branching off of the fourth primary channel leg 128 extend along the longitudinal and lateral ribs 78, 80 toward the pallet side 34 and end 36 in the quadrant 106. Each secondary channel 19 remains on the upper or lower rib edge 84, 86 on which it originated from the fourth primary channel leg 128. The fourth leg 128 terminates encircling the corner foot 18 at 159 and extending down the corners 156 of each convolution 48 in the corner foot 18.

Additional secondary channels may also be formed in the structural flanges 88, 92 along the upper edges 84 of the longitudinal and lateral ribs 78, 80 between the quadrants 106. The invention may be practiced without any secondary channels 19, but if they are provided, they further increase the pallet 10 strength without providing additional material which increases the pallet weight. If the gas charging method of forming the channels is used, the secondary channels will typically be of varying length (depending on processing conditions) and not necessarily continuous or joining with the secondary channels of adjacent quadrants.

Referring to FIGS. 1—4, the pallet deck has an edge portion 4 formed by edge ribs 162 supporting a skirt 158 around the pallet deck 12 periphery. Edge ribs 162 extending outward from the grid 76 periphery supports the skirt 158 and a skin 160. A skin 160 formed on the deck top 14 extends inward from the pallet sides 30, 34, and ends 32, 36 toward the pallet center 161 covering the edge ribs and the outermost grid squares 162 of the rib grid 76. The skin 160 strengthens the pallet sides 30, 32, 34, 36 and the grid 76 around the corner and side feet 18, 20, 22. Auxiliary ribs 164 bisect the skin covered squares 162 providing additional support for the skin 160.

Holes 96, 168 for securing an anti-skid rubber grommet (not shown) on the top or bottom of the pallet deck 12 are spaced about the deck top 14 within the area defined by the skin 160 and within grid squares 82 at the deck bottom 16. Preferably, four top holes 168 are spaced along each pallet side 30, 32, 34, 36 disposed within the area covered by the skin 160 for a total of sixteen top holes 168. Four additional bottom holes 96 in each quadrant 106, two disposed on opposite sides of the channel diagonal 120, are formed in the area defined by grid squares 82 at the deck bottom 16, providing a total of sixteen bottom holes 96 for the entire pallet 10. A grommet attachment hole 97 is also provided in each foot. Grommets provided in the feet keep the pallet from sliding around on the floor, grommets in the bottom of the deck in the fork passages keep it from sliding around on top of fork lift forks, and grommets provided on the upper surface of the deck keep the load, i.e., plastic boxes filled with components, from sliding around.

Thus, there has been described, and shown in FIGS. 1–16, an injection molded plastic pallet 10 having hollow structural channels 17, 19 formed in it in a manner which increases its strength, while reducing its weight and the volume of plastic material used in comparison to a solid pallet of the same capacity or exterior dimensions. The hollow structural channels 17, 19 in some areas of the pallet 10 run along the top surface 14 of the pallet deck 12, and in other areas, run along the bottom surface 16 of the pallet deck 12. In particular, as a hollow channel 17 traverses a quadrant 106, either longitudinally, laterally or diagonally, the channel 17 crosses over from the deck top 14 to the deck bottom 16 when it enters a central zone of the quadrant 106, and crosses back to the deck top 14 when it exits the central zone, as it continues across the quadrant 106. The central zone of the quadrant 106 being defined as the zone between the feet 18, 20, 22, 24 at each corner of the quadrant 106 defining an X centrally disposed in the quadrant 106. For example, in FIG. 12B, the hollow channels 17 crossover between the top and bottom of the pallet where they cross the axes 183, 187, in the central zone of the quadrant. The secondary channels 19 adjacent to the lateral and longitudinal channels 17 also cross over between the pallet top and bottom where they cross the axes 183, 187.

Solid structural flanges 88, 94 on either one or both sides of the ribs 78, 80 that make up the deck grid 76 can also be made to cross over from the deck top 14 to the deck bottom 16 and then back to the deck top 14 when they cross either longitudinally or laterally the quadrant central zones between adjacent feet, including for a small distance (e.g., 1–2 squares) to the sides of the two adjacent feet. These flanges 88, 94 can be formed on the hollow channels 17, 19 as well so as to run along the outer side of the channel 17, 19, i.e., on top of the channel when the channel is on deck top 14, and along the bottom of the channel when the channel runs along the deck bottom 16.

The high tensile stress areas at the deck bottom 16 between pallet feet are fortified by the channels 17, 19 and flanges 94 running along the deck bottom 16. This fortification is of particular benefit when the feet are supporting the pallet deck 12. In addition, the channels 17, 19 (and solid flanges 88) at the deck top 14 in the areas outside of the central zones (the central zones being directly over the center of the fork lift fork passages defined by the feet under the pallet) serve to reinforce these areas against tensile stress which is experienced when the pallet 10 is picked up by a fork lift.

All of the four corner quadrants 106 of the preferred embodiment are identical, with four primary channel legs 122, 124, 126 and 128 provided in each quadrant 106. Each primary channel leg 122, 124, 126, and 128 is a primary channel 17 which runs to a different one of the four feet that are at least partially included in the quadrant 106. The primary channels legs 122, 124, 126, and 128 cross over from the deck top 14 to the deck bottom 16, and back to the deck top 14, as described above, in the central zones.

In each quadrant 106, two of the primary channel legs 122, 128 run along a diagonal 120 between the pallet center foot 24 and the pallet corner foot 18, and are coterminous with one another. Another primary channel leg 124 branches off from the diagonal primary channel 122 and extends laterally to the vicinity of one of the two side/end feet 20, 26 of the quadrant 106, and another primary channel leg 126 branches off from the same point on the diagonal channel 122, and extends longitudinally to the vicinity of the other of the two side/end feet 20, 26 of the quadrant 106. Each of the primary channel legs 124, 126 that leads to a side or end foot 20, 26 is joined to a channel 140, 150 that surrounds the top of the side or end foot 20, 26 by two branch channels 138, 148, which run orthogonally to the primary channel leg 124, 126.

The hollow channels (e.g., 140 in FIG. 10) surrounding the top of each of all nine of the feet of the pallet are connected to one or more primary channel legs from each of the four quadrants 106. The hollow channel 159 surrounding each corner foot 18 has a single primary channel leg 128 leading into it. The hollow channel 140 surrounding each side foot 20 has two primary channel legs 124 leading to it, one from each adjacent quadrant 106. The hollow channel surrounding the center foot 24 has four primary channels 122 leading to it, one from each of the four corner quadrants 106 of the pallet 10.

Each pallet foot (e.g., 22) is formed with convolutions (e.g., 72) which run up and down the foot side. The convolutions are indents or ridges in the side of the foot which define corners. Each convolution corner has a hollow channel (e.g., 152, FIG. 11) running through it which opens into the top channel 140 which surrounds the foot, and which further reinforces the load carrying ability of the foot. This is accomplished without the channel defining a distinct exterior shape indicative of a channel, since it is formed in the corner of the convolution.

While there has been shown and described the preferred embodiment of the invention, it will be obvious to those skilled in the art that various changes and modifications can be made therein without departing from the spirit of the invention.

We claim:

1. An injection molded pallet having a deck with a top and bottom, and a plurality of feet extending downwardly from said deck, wherein said feet support said deck and define fork lift passages therebetween, and said pallet deck is a grid formed of a plurality of spaced ribs having upper and lower edges, the improvement comprising hollow channels formed in said pallet for strengthening said pallet, and at least one of said ribs includes a first section having a hollow channel formed in at least a portion of said upper edge of said first section with said rib being solidly below said hollow channel and said at least one of said ribs includes a second section which is different from said first section, said second section having a hollow channel formed in at least a portion of said rib lower edge of said second section with said rib being solid above said hollow channel.

2. A pallet as in claim 1, in which said hollow channels define a pattern in said deck.

3. A pallet as in claim 2, in which said pattern is substantially identical in each of four quadrants of said deck.

4. A pallet as in claim 2, in which said pattern includes at least one primary hollow channel extending toward a corner of said quadrant.

5. A pallet as in claim 4, wherein said primary hollow channel extends along a diagonal across said quadrant.

6. A pallet as in claim 5, wherein said pattern includes hollow channels extending from said diagonal primary channel.

7. A pallet as in claim 1, including a crossover channel extending from said upper edge to said lower edge connecting said hollow channel formed in said rib upper and lower edges.

8. A pallet as in claim 1, including hollow channels formed in a portion of said lower edges of ribs disposed above said fork lift passages.

9. A pallet as in claim 1, including structural flanges formed on said rib upper or lower edges.

10. A pallet as in claim 9, including a crossover flange extending from said upper edge to said lower edge connecting structural flanges formed on said rib upper and lower edges.

11. A pallet as in claim 9, including structural flanges formed on a portion of said lower edges of ribs disposed above said fork lift passages.

12. A pallet as in claim 1, in which at least one of said feet is formed as an integral part of said deck having an open top formed at the deck top, and extending through the deck bottom for engagement of a supporting surface by a foot bottom.

13. A pallet as in claim 12, including a convolution formed as part of a side of one of said feet, said convolution extending from a foot top toward a foot bottom of said foot.

14. A pallet as in claim 13, including a hollow channel formed in a corner of said convolution.

15. A pallet as in claim 1, including a hollow channel formed in said dock surrounding at least one of said feet.

16. A pallet as in claim 15, wherein said channel surrounding at least one of said feet is interested by another channel which extends into said deck away from said foot.

17. A pallet as in claim 1, including an edge portion formed by edge ribs extending outward from said grid and supporting a skirt surrounding said pallet deck grid.

18. A pallet as in claim 17, including a skin formed on said deck top, and extending inwardly from said pallet skirt.

19. A pallet as in claim 1, including grommet holes formed in said pallet.

20. A pallet as in claim 1, in which said hollow channels are formed by injecting a gas into said pallet during molding.

* * * * *

UNITED STATES PATENT AND TRADEMARK OFFICE

CERTIFICATE OF CORRECTION

PATENT NO. : 6,216,609 B1
DATED : April 17, 2001
INVENTOR(S) : Jason R. Frankenberg It is certified that error appears in the above-identified patent and that said Letters Patent is hereby corrected as shown below:

Column 1,
Line 41, “single of” should be -- single or --;

Column 5,
Line 59, “legs 22” should be -- legs 122 --;

Column 6,
Line 6, “13 an 14” should be -- 13 and 15 --;
Line 17, “and” should be -- the --;

Column 7,
Line 27, “FIGS. 1-4” should be -- FIGS. 1-3”;
Line 48, “formed in the” should be -- formed in an --;
Line 53, “around on the” should be -- around on a --;

Column 10,
Line 32, “dock” should be -- deck --;
Line 34, “interested” should be -- intersected --.

Signed and Sealed this

Thirteenth Day of August, 2002

*Attest:*

*Attesting Officer*

JAMES E. ROGAN
*Director of the United States Patent and Trademark Office*